US005641603A

United States Patent [19]

Yamazaki et al.

[11] Patent Number: 5,641,603

[45] Date of Patent: Jun. 24, 1997

[54] HEAT FIXING METHOD

[75] Inventors: Hiroshi Yamazaki; Kazuo Yasuda; Kazuhiko Uneme, all of Tokyo, Japan

[73] Assignee: Konica Corporation, Japan

[21] Appl. No.: 528,725

[22] Filed: Sep. 15, 1995

[30] Foreign Application Priority Data

Oct. 5, 1994 [JP] Japan ..... 6-266376

[51] Int. Cl.[6] ..... G03G 13/20

[52] U.S. Cl. ..... 430/124; 430/99; 430/109; 427/194

[58] Field of Search ..... 430/124, 99, 109; 118/60; 427/194, 375, 361

[56] References Cited

U.S. PATENT DOCUMENTS

| | | | |
|---|---|---|---|
| 4,254,733 | 3/1981 | Namiki | 118/60 |
| 4,585,723 | 4/1986 | Kishi et al. | 430/106 |
| 5,346,792 | 9/1994 | Kobayashi et al. | 430/109 |
| 5,395,725 | 3/1995 | Bluett et al. | 430/124 |

*Primary Examiner*—Janis L. Dote

*Attorney, Agent, or Firm*—Jordan B. Bierman; Bierman, Muserlian and Lucas LLP

[57] ABSTRACT

A fixing method comprises the step of passing a recording material with a toner image between a heat member and a pressure applying member contacting the heat member to fix the toner onto the recording material, a silicone oil being coated on the surface of the heat member, wherein the toner contains a polyester comprising a unit derived from an aromatic polycarboxylic acid or its anhydride or a unit derived from an aromatic polyhydric alcohol, and the silicone oil is a fluorine-containing silicone oil having a structure unit represented by the following Formula (I):

Formula (I)

17 Claims, 2 Drawing Sheets

HEAT FIXING METHOD

FIELD OF THE INVENTION

The invention relates to a heat fixing method for electrophotography, and to a contact-type heat fixing method which effectively prevents occurrence of offset phenomenon and which effectively prevents staining of a fixing roller.

BACKGROUND OF THE INVENTION

In electrophotography, a heat roller fixing method has been widely used to fix toner onto a recording material in view of its heat efficiency or suitability to high speed fixing. This heat roller fixing method is a method which passes a recording material having a toner image thereon between a heat roller with a heat source therein and a pressure applying roller, fusibly fixes the toner onto the recording material. In this method, although the method has the above advantages, there is the so-called "offset phenomenon" disadvantage in which toner on a recording material is transferred to a heat roller, and after the rotation of the heat roller the toner is transferred to undesired portions of another recording material and fixed, resulting in staining on the recording material.

In order to prevent the offset phenomenon of the fixing roller, a technique supplying a dimethyl silicone oil onto the surface of the heat fixing roller has so far been proposed.

This method effectively prevents the offset phenomenon, however, it requires a silicone oil supplying device and has further a problem of smoking. On the other hand, there are many proposals which give anti-offset property to the toner itself, for example, a technique using a resin having a broad molecular weight distribution as a binder resin in the toner as disclosed in Japanese Patent O.P.I. Publication No. 50-234652/1975 and a technique adding a releasing agent such as a low molecular weight polypropylene as disclosed in Japanese Patent O.P.I. Publication No. 49-65231/1974.

The above proposed techniques definitely have an excellent effect on the prevention of the offset phenomenon, however, there is the problem in that they have only a narrow fixing temperature range and do not sufficiently show a fixing property, resulting in reduced life time of the fixing roller due to staining. The conventional silicone oil has a positive-charging property as a frictional electrification property, and the fixing roller having the silicone oil on the surface is likely to be positively charged. Therefore, when toner having a negative-charging property is used, a phenomenon is likely to occur in which a recording material is wound around the fixing roller, and when the conventional silicone oil is applied to the fixing roller, there is a limitation to toner used.

There has recently been proposed a technique in which a stationary heated member, in place of the heat fixing roller, contacts a pressure applying roller through a moving film material, and a recording material with a toner image is passed between the roller and the film to fusibly fix the toner, as disclosed in Japanese Patent O.P.I. Publication No. 5-119530/1993. This fixing method has an excellent heat efficiency, but has the same disadvantages as the above heat roller fixing method.

SUMMARY OF THE INVENTION

An object of the invention is to provide a heat fixing method which is free from occurrence of the offset phenomenon over a broad fixing temperature range, the winding phenomenon in which a recording material is wound around the fixing roller, and staining on the fixing roller.

DETAILED DESCRIPTION OF THE INVENTION

Figure 1:
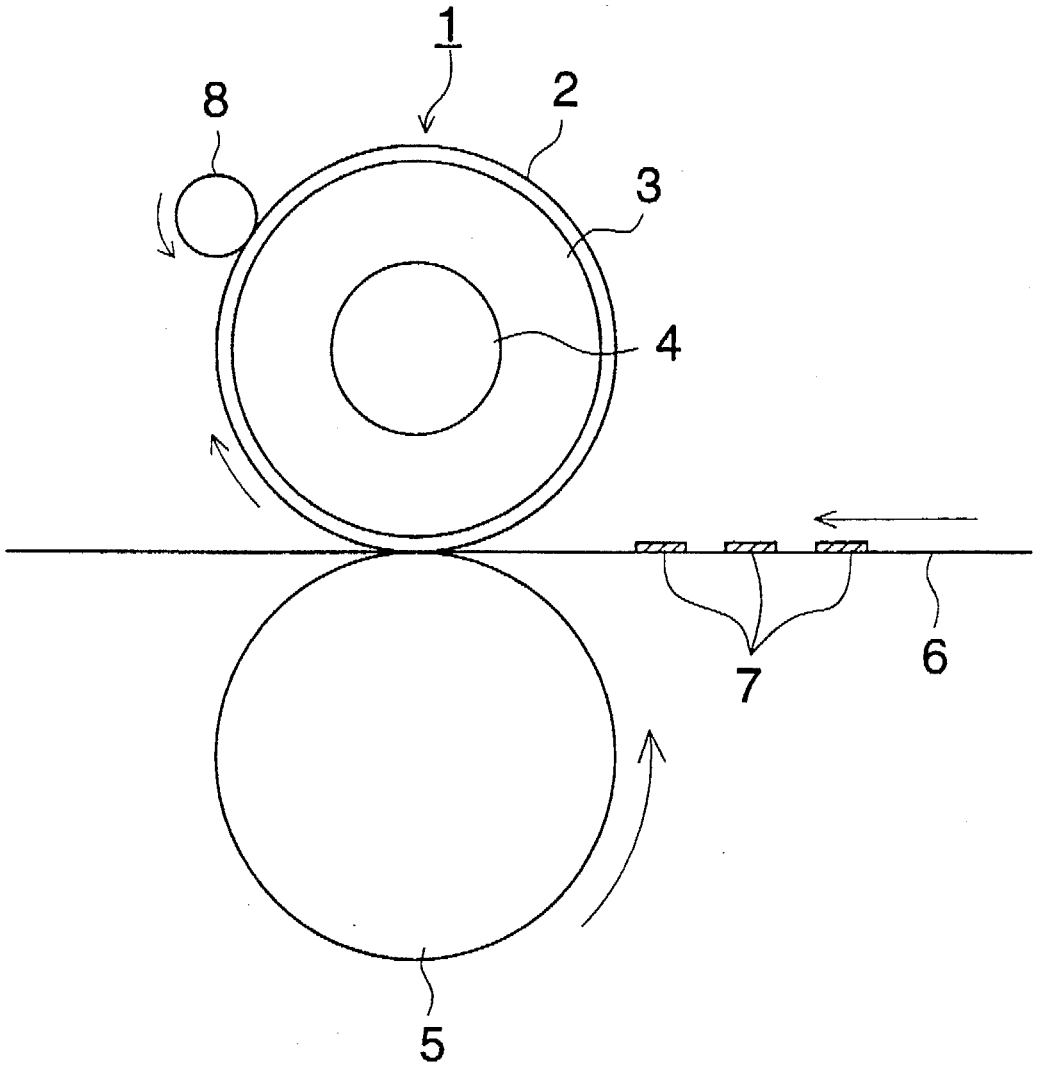
FIG. 1 shows an example of a heat roller fixing device in the invention.

The above object of the invention can be attained by the following:

1. a fixing method comprising the step of passing a recording material with a toner image between a rotating fixing roller and a pressure applying roller contacting the fixing roller to fix the toner onto the recording material, a silicone oil being coated on the surface of the fixing roller, wherein the toner contains a polyester derived from an aromatic polycarboxylic acid or its anhydride or an aromatic polyhydric alcohol, and the silicone oil is a fluorine-containing silicone oil having a structure unit represented by the following Formula (I):

Formula (I)

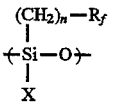

wherein X represents a saturated hydrocarbon group having 1 to 4 carbon atoms or an aryl group; $R_f$ represents a fluoroalkyl group having 2–10 carbon atoms; and n represents an integer of 1 to 4, or 2. a fixing method comprising the step of passing a recording material with a toner image between a moving film material and a rotating pressure applying member so that the toner image contacts the film material to fix the toner onto the recording material, the film material being positioned to contact the pressure applying member between a stationary heat source and the pressure applying member, silicone oil being coated on the surface of the film material on the pressure applying member side, wherein the toner contains a polyester derived from an aromatic polycarboxylic acid or its anhydride or an aromatic polyhydric alcohol, and the silicone oil is a fluorine-containing silicone oil having a structure unit represented by the following Formula (I):

Formula (I)

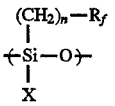

wherein X represents a saturated hydrocarbon group having 1 to 4 carbon atoms or an aryl group; $R_f$ represents a fluoroalkyl group having 2–10 carbon atoms; and n represents an integer of 1 to 4.

The heat fixing method of the invention will be detailed below.

The fluorine-containing silicone oil of the invention is a silicone oil having a structure unit represented by the above formula (I).

In formula (I), X represents a saturated hydrocarbon group such as an alkyl group having 1 to 4 carbon atoms including a methyl, ethyl, propyl or butyl group or an aryl group such as a phenyl or naphthyl group; $R_f$ represents a fluoroalkyl group having 2 to 10 carbon atoms, preferably 2 to 8 carbon atoms, and $R_f$ preferably represents $Z—(CF_2)_m—$ wherein Z represents a hydrogen atom or a fluorine atom and m represents an integer of 2 to 10, preferably 2 to 8; and n represents an integer of 1 to 4.

It is essential that the fluorine-containing silicone oil of the invention have the above structure unit, but may be a copolymer further comprising a dimethyl silicone, phenylmethyl silicone or diphenyl silicone structure unit.

It is essential that the fluorine-containing silicone oil of the invention be a liquid having an appropriate viscosity on its usage and an oil having a molecular weight to some degree. Considering the degree of attaining the invention and the oil film-forming property on the fixing roller, the molecular weight has a viscosity of 20 to 1,000 centipoise (CS), and preferably 100 to 500 CS at 25° C. in terms of viscosity. The viscosity shows a kinetic viscosity, and is measured by means of a Ubbelohde's viscometer according to ASTM D445-46T or JIS Z8803. This viscosity can be controlled while adjusting the degree of polymerization in manufacturing the fluorine-containing silicone oil of the invention.

When the fluorine-containing silicone oil of the invention is a copolymer, the silicone oil preferably contains 20 mol % or more of the structure unit represented by Formula (I) in view of the degree of attaining the object of the invention. When the fluorine-containing silicone oil of the invention contains less than 20 mol % of the unit, the degree of attaining the invention deteriorates and property based on the other structure unit is likely to be effected, so that there sometimes occurs a problem that the object of the invention may not be attained.

The fluorine-containing silicone oil of the invention is synthesized in the same manner as the conventional silicone oil synthetic method. The dialkyl-substituted dichlorosilane is prepared from dichlorosilane and an alkyl chloride, and is hydrolyzed to form a siloxane. Thereafter, the cyclic oligomer or linear oligomer is formed and polymerized to obtain a silicone oil. The fluorine-containing silicone oil of the invention is one having a fluoroalkyl group in the side chain, and synthesized using a fluorine-containing compound having a chloro group at the end instead of an alkylchloride, for example, a compound having a structure represented by the following Formula (II)

Formula (II)

$$Z—(CF_2)_m(CH_2)_nCl$$

wherein Z represents a group denoted as above; m represents an integer of 2 to 10: and n represents an integer of 1 to 4.

The typical examples of the compound represented by the following Formula (II) will be shown below.

(A) $CF_3CF_2CH_2Cl$
(B) $CF_3CF_2CF_2CH_2Cl$
(C) $CF_3CF_2CF_2(CH_2)_2Cl$
(D) $CF_3CF_2CF_2CF_2(CH_2)_2Cl$
(E) $CF_3CF_2CF_2CF_2CF_2CH_2Cl$
(F) $CF_3CF_2CF_2CF_2CF_2(CH_2)_2Cl$
(G) $CF_3CF_2CF_2CF_2CF_2CF_2CH_2Cl$
(H) $CF_3CF_2CF_2CF_2CF_2CF_2CF_2CH_2Cl$
(I) $HCF_2CF_2CH_2Cl$
(J) $HCF_2CF_2CF_2CH_2Cl$
(K) $HCF_2CF_2CF_2(CH_2)_2Cl$
(L) $HCF_2CF_2CF_2CF_2CH_2Cl$
(M) $HCF_2CF_2CF_2CF_2(CH_2)_2Cl$
(N) $HCF_2CF_2CF_2CF_2(CH_2)_4Cl$
(O) $HCF_2CF_2CF_2CF_2CF_2(CH_2)_2Cl$
(P) $HCF_2CF_2CF_2CF_2CF_2CF_2CH_2Cl$

The alkyl chloride for introducing an alkyl group other than a fluoroalkyl group to the oil includes methyl chloride, ethyl chloride, propyl chloride and butyl chloride.

In order to display an effect such as a uniform coating on a fixing roller covered with a fluorine-containing resin using the fluoroalkyl group substituted silicone oil in the invention, the number of the fluorine atoms is considered to play an important role. The fluorine-containing silicone oil of the invention is a silicone oil having a fluoroalkyl group of 2 to 10 carbon atoms, and preferably 2 to 8 carbon atoms, which is directly bonded through a methylene chain to a silicone atom of the silicone oil. When a silicone oil containing no fluoroalkyl group is used, the wettability to a heat fixing roller covered with a fluorine-containing resin is not improved, and a uniform oil coating film is not formed.

The typical examples of the fluorine-containing silicone oil of the invention will be shown below.

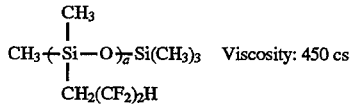
Viscosity: 450 cs (1)

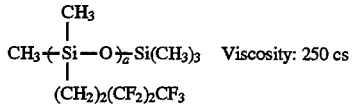
Viscosity: 250 cs (2)

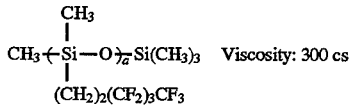
Viscosity: 300 cs (3)

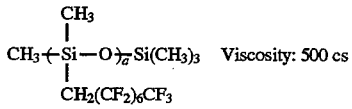
Viscosity: 500 cs (4)

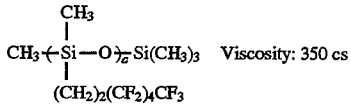
Viscosity: 350 cs (5)

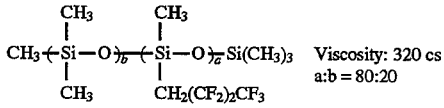
Viscosity: 320 cs a:b = 80:20 (6)

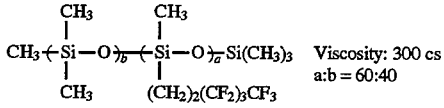
Viscosity: 300 cs a:b = 60:40 (7)

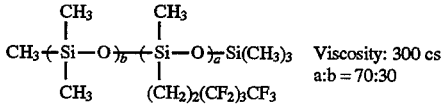
Viscosity: 300 cs a:b = 70:30 (8)

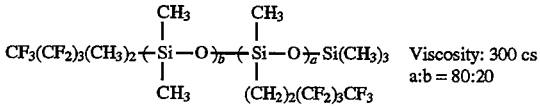
Viscosity: 300 cs a:b = 80:20 (9)

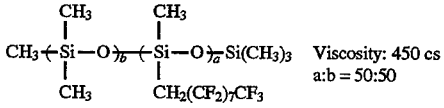
Viscosity: 450 cs a:b = 50:50 (10)

-continued

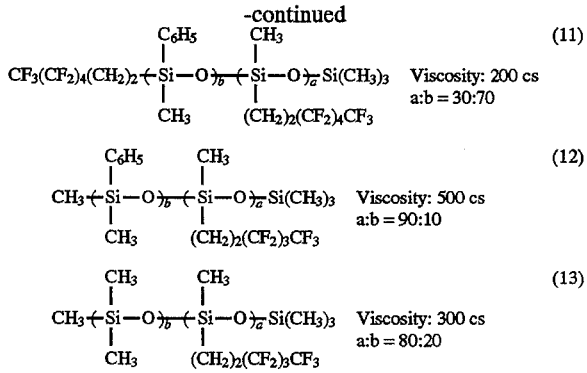

(11) Viscosity: 200 cs a:b = 30:70

(12) Viscosity: 500 cs a:b = 90:10

(13) Viscosity: 300 cs a:b = 80:20

In the above Formula, a and b independently represent an integer of not less than 1, preferably 10 to 2000, and more preferably 100 to 1000.

The toner in the invention contains at least a polyester derived from an aromatic polycarboxylic acid or its anhydride and an aromatic polyhydric alcohol, and a combination use with the fluorine-containing silicone oil of the invention can provide a heat fixing method which can prevent occurrence of the offset phenomenon over such a broad fixing temperature range as has not been experienced in the conventional method, prolong a life of a fixing roller, and further prevent staining on the toner image.

The polyester resin used in the toner of the invention (hereinafter referred to as the polyester of the invention) is obtained by polycondensation of a polycarboxylic acid having two or more carboxy groups with a polyhydric alcohol having two or more hydroxy groups, wherein the polycarboxylic acid and polyhydric alcohol both comprise an aromatic group. Each component will be explained below.

The aromatic polycarboxylic acid includes phthalic acid, terephthatic acid, 1,2,4-benzenetricarboxylic acid, 2,5,7-naphthalenetricarboxylic acid, 1,2,4-naphthalenetricarboxylic acid and pyromellitic acid and an anhydride thereof.

The polycarboxylic acid other than the aromatic polycarboxylic acid includes maleic acid, fumalic acid, cytrconic acid, iraconic acid, succinic acid, adipic acid, sebatic acid, malonic acid, n-dodecylsuccinic acid, n-dodecenylsuccinic acid, isododecylsuccinic acid, isododecenylsuccinic acid, n-acid, n-octenylsuccinic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, empol trimer and an anhydride thereof.

The aromatic polyhydric alcohol includes an etherified bisphenol A such as polyoxypropylene (2. 2)-2,2-bis(4-hydroxyphenyl)propane, polyoxypropylene (3.3)-2,2-bis(4-hydroxyphenyl)propane, polyoxyethylene (2. 0)-2,2-bis(4-hydroxyphenyl)propane, polyoxypropylene (2. 0)-polyoxyethylene (2. 0)-2,2-bis(4-hydroxyphenyl)propane or polyoxypropylene (6)-2,2-bis(4-hydroxyphenyl)propane, bisphenol A, bisphenol Z and 1,3,5-trihydroxymethylbenzene.

The polyhydric alcohol other than the aromatic polyhydric alcohol includes ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane dimethanol, dipropylene glycol, polyethylene glycol, polypropylene glycol, polytetramethylene glycol, hydrogenated bisphenol A, sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, 2-methylpropane triol, 2-methyl-1,2,4-butane triol, trimethylol ethane and trimethylol propane.

The content ratio of the above described carboxylic acid to the alcohol is not limited, but the content ratio is preferably 1:0.95 to 1:0.5 (in moles) in the toner of the invention. The content of each of a tri- or higher hydric or carboxylic component depends upon the cross-linking degree of the polyester. The optimal cross-linking degree is selected due to characteristics of the toner to be obtained whereby the content of each component is adjusted. Generally, the content of the trivalent or higher component is not more than 15 mol %, and preferably 0.1 to 13 mol %.

The cross-linked polyester resin is preferably used in the toner of the invention. The cross-linking degree being represented in terms of content of chloroform insoluble components, the polyester resin is one in which the content of chloroform insoluble components is 5 weight % or more, and preferably 10 to 50 weight %. The chloroform insoluble components herein referred to are components which, when a chloroform solution of a sample material is filtered with a filter paper, do not pass the filter paper. The content is obtained according to the following method.

The resin sample is pulverized and screened with a 40 mesh sieve. The sample minus sieve of 5.00 g and 5.00 g of a filter auxiliary, Radiolight (#700), are placed in a 500 ml vessel, and 100 g of chloroform is added thereto. The vessel containing the resulting mixture is placed on a ball mill shelf and rotated at 20° C. for 5 hours or more to sufficiently dissolve the sample in the chloroform. On the other hand, a filter paper (No. 2) of a diameter of 7 cm, which is placed in a pressure filter, is uniformly pre-coated with 5.00 g of radiolight and is put into close contact with the filter with a slight amount of chloroform. Then, the above obtained solution in the vessel is poured into the pressure filter. The vessel is washed with 100 ml chloroform and the washing chloroform is also poured into the pressure filter so that the residue does not remain on the walls of the vessel. Thereafter, the pressure filter is capped, and filtering is carried out at a pressure of 4 kg/cm$^2$. After the chloroform solution is filtered out, the residue on the filter paper is washed with 100 ml chloroform and the pressure filtering is repeated.

After completion of the above processes, the filter paper, the residue thereon and the Radiolight are placed in an aluminium foil container and is dried for 10 hours at 80° to 100° C. and at 100 mmHg in a vacuum drier. The total weight "a" of the resulting mixture is measured and the weight content "X" (weight %) of the chloroform insoluble components is obtained according to the following equation.

Equation 1

$$X\ (\text{weight }\%)=\{a(g)-F(g)-R(10.00\ g)\}\times 100/S(g)$$

wherein F, R and S represent the filter paper weight, the radiolight weight and the weight of the sample, respectively.

The thus obtained chloroform insoluble components are those composed of a higher molecular weight polymer or a cross-linked polymer, whose molecular weight is considered to be not less than 200,000.

The above chloroform insoluble components can be formed with a controlled content by suitably selecting the reaction conditions or in the presence of an appropriate cross-linking agent in the polymerization reaction of the above described alcohols and carboxylic acids. It is essential that the polyester resin of the invention contain an aromatic ring in the main chain. Regarding the aromatic ring content, the content of the compound having an aromatic ring in the polyester is 10 weight % or more and preferably 30 to 90 weight %. When the aromatic ring content is excessive, the negative-charging property is excessive, resulting in an excessive static repulsion and occurrence of blurring. On the other hand, when the aromatic ring content is too small, negative-charging ability is less, resulting in lowering the effect which reduces adhesion of the toner to the fixing roller.

The resin in the toner of the invention has preferably a weight average molecular weight (Mw) of $1\times10^4$ to $1\times10^6$ and preferably a number average molecular weight (Mn) of $1\times10^3$ to $1\times10^5$ according to the GPC method. The weight average molecular weight (Mw) is more preferably $2\times10^4$ to $5\times10^5$ and the number average molecular weight (Mn) is more preferably $2\times10^3$ to $3\times10^4$. The ratio of the weight average molecular weight (Mw) to the number average molecular weight (Mn) is 4 to 50, and preferably 5–30. The molecular weight referred to herein is in terms of polystyrene molecular weight.

It is essential that the toner of the invention contains the above described polyester of the invention, but may contain other components used in the conventional toner. Of these, a coloring agent used is preferably contained in the toner. The coloring agent contains carbon black, nigrosine dyes, aniline blue, calco oil blue, chrome yellow, ultramarine blue, Dupont oil red, quinoline yellow, methylene blue chloride, phthalocyanine blue, malachite green oxalate and rose bengal.

The other additives include, for example, a salicylic acid derivative, a charge controlling agent such as an azo metal complex and a fixibility improving agent such as a low molecular weight polyolefin and carnauba wax. The inorganic fine particles include silica, titanium oxide, aluminium oxide and barium titanate, strontium titanate, each of which has a number average primary particle diameter of 5 to 1000 nm and may be made hydrophobic.

As a cleaning auxiliary agent, styrene-acryl resin fine particles having a number average primary particle diameter of 0.1 to 2.0 μm or a metal salt of a higher fatty acid such as zinc stearate may be used in toner.

The content of the inorganic fine particles may be 0.1 to 2.0% by weight based on the color particle toner. The cleaning auxiliary agent may be 0.01 to 1.0% by weight based on the color particle toner.

The carrier constituting a dual-component developer may include a non-covered carrier consisting only of magnetic particles such iron or ferrite, a resin-covered carrier in which the surface of magnetic particles is covered with a resin and a resin-dispersed carrier in which a resin and magnetic powder are mixed. The carrier has a volume average particle diameter of preferably 30 to 150 μm.

The magnetic mono-component developer in the invention preferably contains a ferromagnetic material such as magnetite which has a number average particle diameter of 0.1 to 2.0 μm, as a coloring agent. In this case the content of the ferromagnetic material is ordinarily 20 to 60% by weight based on the toner.

Further, in the invention, non-magnetic mono-component toner which consists only of non-magnetic toner without carrier may also be used.

The heat fixing method in the invention is divided into the following two methods; one is a heat roller fixing method, and the other is a method in which heating is carried out through a moving film material and a pressure applying member.

The fixing method will be explained below.

The heat roller fixing method will be explained below using FIG. 1. The heat roller fixing device is composed of an upper roller 1 having a heat source 4 inside a cylinder made of a metal such as iron or aluminium, the surface 2 of which is covered with, for example, tetrafluoroethylene or tetrafluoroethylene-perfluoroalkylvinylether copolymer, and a lower heat roller 5 made of a silicone gum. The heat source 4 has a linear heater, which heats the surface of the upper roller 1 from about 110° to 220° C. The recording material 6 having a toner image 7 thereon is passed between the upper roller 1 and the lower roller 5 to fusibly fix the toner image 7 onto the recording material. Conventional toner causes the offset phenomenon in that some of the fused toner adheres to the upper roller 1 and the adhered toner, after one rotation of the roller, further adheres to undesired portions of the recording material. In extreme cases, there occurs the winding phenomenon that the recording material is caught by the toner having been adhered to the upper roller 1 and wound around the roller 1. In the heat roller fixing device, pressure is applied, deforming the lower roller and forming a nip between the upper and lower rollers. The fixing pressure in the invention is 0.1 to 2.0 kg/cm, and preferably 0.5 to 1.0 kg/cm in terms of line pressure or 5 to 30 kg, and preferably 10 to 25 kg in terms of total pressure. The nip width is 1 to 10 mm, and preferably 1.5 to 7 mm. The fixing line speed is preferably 40 to 400 mm/second. When the nip width is less, it is difficult to apply a uniform heat to toner, resulting in fixing unevenness. When, on the other hand, the nip width is larger, toner fusing is promoted, and the offset phenomenon is more likely to occur.

In the heat roller fixing method of the invention, the fluorine-containing silicone oil film according to the invention is formed on the surface of upper roller 1. This film and the toner of the invention interact each other and the objects of the invention can be effectively attained.

One example of the method, in which the fluorine-containing silicone oil is supplied to upper roller 1 to form the silicone oil film, is as follows:

The fluorine-containing silicone oil impregnated pad roller 8 contacts the surface 2 of upper roller 1 and rotates in the arrow direction. The pad roller 8 is impregnated in advance with the fluorine-containing silicone oil of the invention to obtain the oil impregnated pad roller 8, and the fluorine-containing silicone oil of the oil impregnated roller 8 is supplied to the surface 2 of upper roller 1 little by little according to the rotation of the upper roller 1, whereby the fluorine-containing silicone oil film of the invention is formed on the surface 2 of the upper roller 1.

Next, the latter fixing methods in the invention will be explained.

The methods will be explained below using FIG. 2. The low heat content linear heater 15, which is attached to a fixing device, is composed of an aluminium base 17 having a thickness of 0.2 to 5.0 mm (preferably 0.5 to 3.5 mm), a width of 10 to 15 mm and a longitudinal length of 240 to 400 mm and coated thereon, a 1.0 to 2.5 mm thick resistant material, and is electrified from the both ends. The electrifying, which is controlled by a temperature sensor 16, is carried out in a pulse wave of 25 msec. period and DC 100 V and in a pulse width varied due to temperature and energy required. The surface temperature T2 of film material 14 directly under the resistant material is lower than temperature T1 detected by temperature sensor 16 in the low heat content linear heater. The temperature T1 is preferably 110° to 220° C., and temperature T2 is preferably 0.5° to 10° C. lower than temperature T1. The temperature T3 of the surface of the film material 14 at the point where the film material is separated from the toner fixing surface is substantially the same as temperature T2. The film material, which contacts the energy or temperature controlled heater, moves in the same direction as the recording material. The film material is a 10 to 35 μm thick heat resistant film such as polyester, polyperfluoroalkylvinyl ether, polyimide or polyetherimide which is covered with a 5 to 15 μm thick releasing layer containing a fluorine containing resin such as teflon and a conductive material, and is preferably an endless belt. The total thickness of the film material is generally 10 to 100 μm.

The film material 14 is transported without being crumpled and twisted by means of both transporting force of a transporting roller 11 and tension force of a freely moving roller 12. The fixing line speed is preferably 40 to 50 mm/second. The total pressure of 5 to 30 kg, preferably 10 to 25 kg or line pressure of 0.1 to 2.0 kg/cm, preferably 0.5 to 1.0 kg/cm is applied by the pressure roller 13, which has an elastic layer of high separability made of, for example, a silicone gum, to contact the film material 14 with the low heat content linear heater 15. The pressure roller 13 rotates in the arrowed direction and passes the toner carrying recording material between the film material 14 and the pressure roller 13, whereby the toner contacts the low heat content linear heater 15 to be fusibly affixed onto the recording material.

Another example of the latter fixing method will be explained below using FIG. 3.

Figure 2:
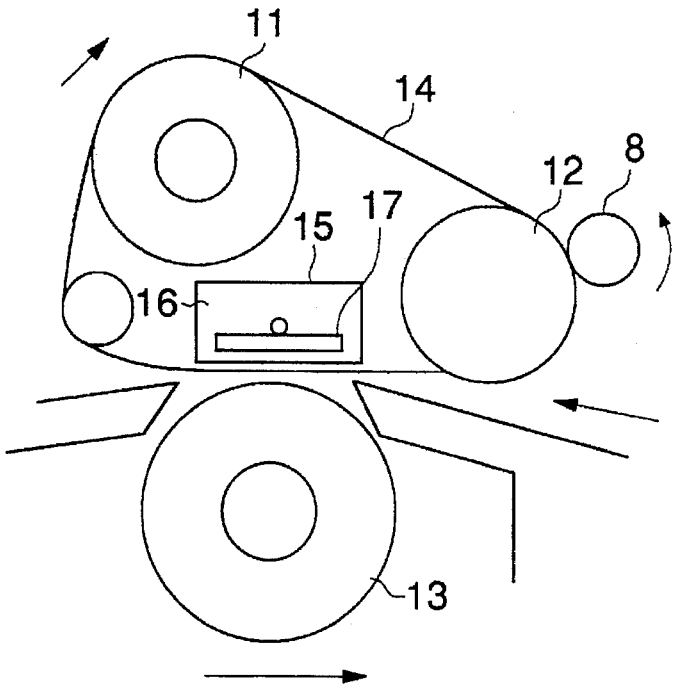
FIG. 2 shows an example of a heat fixing device in which a recording material contacts a heated member through a film material.
Figure 3:
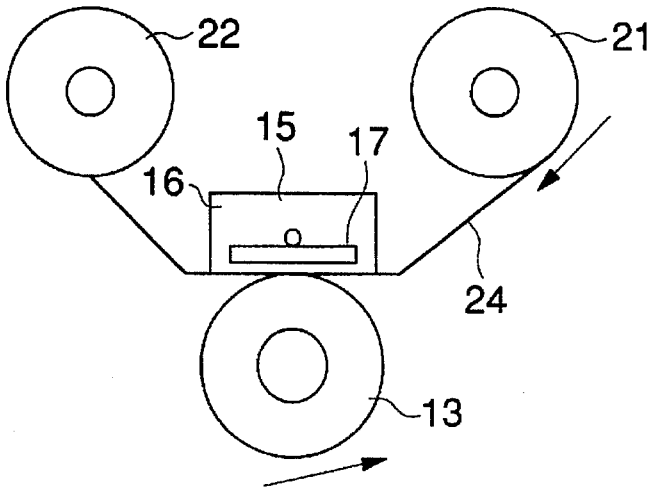
FIG. 3 shows an example of a heat fixing device in which the device shown in FIG. 2 is modified.

The example of FIG. 3 comprises a non-loop film material having two ends, in contrast to the FIG. 2 example comprising the endless film material. As shown in FIG. 3, the non-loop film material 24 is wound around a sheet feeding shaft 21 and a sheet winding shaft 22, and moves in crements in the arrowed direction. In this case, the winding shaft is powered. The numbers 13, 15, 16 and 17 are the same as those denoted in FIG. 2.

The film material 24, which has been wound around the sheet feeding shaft, is rolled around the winding shaft 22 little by little every fixing process whereby the toner carrying recording material passes between the film material 24 and the pressure roller 13, so that the toner contacts the low heat content linear heater 15 to be fusibly affixed onto the recording material.

In the fixing method according to FIGS. 2 and 3, the fluorine-containing silicone oil film of the invention is formed on the surface of the film materials 14 and 24. The method forming the oil film is the same as that described in FIG. 1 and the oil impregnated roller 8 can be employed.

As a oil forming method other than the above described a pad or web impregnated with the fluorine-containing silicone oil film of the invention may be used. In order to attain the object of the invention, the fluorine-containing silicone oil film of the invention may be formed on the surface of the fixing roller in a mono molecular layer. The maximum thickness of the oil film on the fixing roller or film material is preferably not more than $1.4\times10^{-6}$ cc/cm$^2$, and more preferably not more than $1.0\times10^{-6}$ cc/cm$^2$.

Typical examples of the invention will be shown below. The term "parts" refers to weight parts, unless otherwise specifically noted.

EXAMPLES

Preparation of toner

Synthetic example of a resin

In a reaction vessel equipped with a thermometer, a stirrer, a nitrogen introducing tube and a condenser were placed a polyvalent carboxylic acid and polyhydric alcohol as shown in Table 1 in amounts shown in Table 1. The resulting mixture was heated under a nitrogen atmosphere, added with a slight amount of dibutyltin oxide and the reaction was carried out at 200° C. The reaction was initially carried out between bifunctional compounds, and tri- or more-functional compounds were added at the time dibutyltin oxide was added. The reaction was stopped at the time predetermined chloroform-insoluble components or compounds having a predetermined molecular weight were obtained. In the following Table 1, the amounts of the compounds are given in terms of weight ratio.

TABLE 1

| | Aromatic Polyvalent Carboxylic Acid | | | Aliphatic | Aromatic | Aliphatic Polyvalent Alcohol | | |
|---|---|---|---|---|---|---|---|---|
| | Trifunctional | Bifunctional | | carboxylic Acid | Divalent Alcohol | Trifunctional | Bifunctional | |
| Resin No. | TMA | TPA | IPA | DKA | BPA | PG | NPG | TMP |
| Resin 1 | 6 | 74 | 5 | 15 | 27 | 66 | 7 | |
| Resin 2 | 6 | 74 | | 20 | 15 | 70 | 15 | |
| Resin 3 | 5 | 50 | 10 | 35 | 10 | 65 | 25 | |
| Resin 4 | 6 | 74 | | 20 | | 65 | 30 | 5 |
| Resin 5 | 4 | 54 | 2 | 40 | | 75 | 25 | |
| Resin 6 | | 80 | | 20 | 5 | 75 | 20 | |
| Comparative Resin 1 | | | | 100 | | 75 | 25 | |
| Comparative Resin 2 | | | | 100 | | 70 | 20 | 10 |

*TMA: 1,2,4-Benzenetricarboxylic acid
*TPA: Telephthalic acid
*IPA: Isophthalic acid
*DKA: n-Dodecenylsuccinic acid
*BPA: Polyoxypropylene(2,2)-2,2-bis(4-hydroxyphenyl)propane
*PG: Propylene glycol
*NPG: Neopentyl glycol
*TMP: Trimethylol propane The chloroform-insoluble components and the content of the aromatic compounds in the above described resins were shown in the following Table 2.

TABLE 2

| Resin No. | Aromatic Compound Content | Chloroform-Insoluble Component Content |
|---|---|---|
| Resin 1 | 59.6% | 34% |
| Resin 2 | 47.5% | 27% |
| Resin 3 | 37.5% | 17% |
| Resin 4 | 40.0% | 40% |
| Resin 5 | 30.0% | 12% |
| Resin 6 | 42.5% | 0% |
| Comparative Resin 1 | 0% | 0% |
| Comparative Resin 2 | 0% | 17% |

One hundred parts of each of the above obtained resins and 6 parts of carbon black were mixed, fusibly-kneaded, pulverized and classified to obtain color particles having a volume average particle diameter of 8.5 μm. Thereafter, hydrophobic silica was added thereto in an amount of 0.7% by weight to obtain toner. The molecular weight of the resins was measured using the above toner, and the results are shown in Table 3.

The molecular weight measured by GPC is one represented in terms of molecular weight of polystyrene.

TABLE 3

| Toner | Resins | Weight Average Molecular Weight (Mw) | Number Average Molecular Weight (Mn) | Mw/Mn |
|---|---|---|---|---|
| Toner 1 | Resin 1 | $6 \times 10^4$ | $3 \times 10^3$ | 20 |
| Toner 2 | Resin 2 | $5 \times 10^4$ | $3 \times 10^3$ | 17 |
| Toner 3 | Resin 3 | $5 \times 10^4$ | $4 \times 10^3$ | 12 |
| Toner 4 | Resin 4 | $7 \times 10^4$ | $3 \times 10^3$ | 23 |
| Toner 5 | Resin 5 | $4 \times 10^4$ | $4 \times 10^3$ | 10 |
| Toner 6 | Resin 6 | $5 \times 10^4$ | $4 \times 10^3$ | 13 |
| Comparative Toner 1 | Comparative Resin 1 | $4 \times 10^4$ | $5 \times 10^3$ | 8 |
| Comparative Toner 2 | Comparative Resin 2 | $6 \times 10^4$ | $5 \times 10^3$ | 12 |

Each of these toners was mixed with a ferrite carrier (having a volume average particle diameter of 62 μm) covered with a styrene-acryl resin to obtain developer having a toner content of 7 weight %.

* For a copier for evaluation, Konica 3035 produced by Konica Corporation was modified and used. The fixing device of Konica 3035 was modified to obtain the following fixing conditions:

Fixing Condition of Heat Roller

As illustrated in FIG. 1 for heat roller, the heat roller fixing device has an upper roller 1, an iron cylinder of a 30 mm diameter, which is covered with tetrafluoroethyleneperfluoroalkylvinylether copolymer, with an internal heater, and a lower roller 5, a silicone gum of a 30 mm diameter, which is covered with tetrafluoroethyleneperfluoroalkylvinylether copolymer. The line pressure is 0.8 Kg/cm, and the nip width is 4.3 mm. The printing line speed of the fixing device is 250 mm/second. As a cleaning device of this fixing device was used a pad roller 8 impregnated with the fluorine-containing silicone oil of the invention. As the fluorine-containing silicone oil, Exemplified compound (3), (7), (8) and (9) were used, which were designated to be R-1, R-2, R-3 and R-4, respectively. The surface temperature of upper roller 1 varies from 110° to 230° C.

Fixing Condition of Film Fixing Device

As is illustrated in FIG. 2, the film fixing device has an endless film sheet, and the fixing conditions are as follows:

Fixing Condition

Heater temperature T1=110° to 230° C.

Speed of the film material 14=250 mm/second

Total pressure between heater 15 and pressure applying roller 13=15 kg

Nip between pressure applying roller 13 and film material 14=3 mm

Film material 14

Fifteen μm thick polyimide film, which is covered with polytetrafluoroethylene on the surface of which a conducting material is dispersed.

This fixing device was equipped with a cleaning device, pad roller 8 impregnated with the fluorine-containing silicone oil in the same manner as FIG. 1. As the fluorine-containing silicone oil, Exemplified compound (3), (7), (8) and (9) were used, which were designated to be F-1, F-2, F-3 and F-4, respectively.

For comparison, a silicone oil composed of dimethyl polysiloxane (dimethyl silicone oil) or a fluorinated silicone oil (FS-1265 produced by Dow Corning Co., Ltd.) having a simple trifluoromethyl group as a side chain fluorinated alkyl as described in Japanese Patent O.P.I. Publication No. 52-124338/1977 was used in the above described fixing device. The heat roller fixing device using the dimethyl silicone oil was designated to be R-C1, the heat film material fixing device using the dimethyl silicone oil to be F-C1, the heat roller fixing device using the fluorinated silicone oil to be R-C2, and the heat film material fixing device using the fluorinated silicone oil to be F-C2.

(Evaluation)

Evaluation of offset property

A 5×5 $cm^2$ lattice image having 0.2 mm wide lines arranged at intervals of 5 mm was transferred without being fixed onto a leading edge of paper, and using the resulting paper, offset property was evaluated. The fixing temperature was raised from 110° C. to 230° C. at 5° C. increments, the temperature at which a portion of the lattice image was transferred to non-image portions of the paper was evaluated as an offset occurrence temperature, and the temperature range at which no offset occurred was measured. The results are shown in Tables 4 and 5.

TABLE 4

| Toner | Heat Roller Fixing device (°C.) | | | | | |
|---|---|---|---|---|---|---|
| | R-1 | R-2 | R-3 | R-4 | R-C1 | R-C2 |
| Toner 1 | 115–230 | 115–230 | 115–230 | 115–230 | 140–180 | 130–190 |
| Toner 2 | 115–230 | 115–230 | 115–230 | 115–230 | 140–180 | 135–190 |
| Toner 3 | 115–230 | 115–230 | 115–230 | 115–230 | 140–180 | 135–190 |
| Toner 4 | 120–230 | 120–230 | 120–230 | 120–230 | 145–185 | 140–190 |
| Toner 5 | 120–230 | 120–230 | 120–230 | 120–230 | 145–175 | 140–175 |
| Toner 6 | 115–210 | 115–210 | 115–210 | 115–210 | 150–170 | 145–170 |
| Comparative Toner 1 | 150–190 | 150–190 | 150–190 | 150–190 | 150–170 | 145–175 |
| Comparative Toner 2 | 150–200 | 150–200 | 150–200 | 150–200 | 150–180 | 145–180 |

TABLE 5

| Toner | Film Material Fixing device (°C.) | | | | | |
|---|---|---|---|---|---|---|
| | F-1 | F-2 | F-3 | F-4 | F-C1 | F-C2 |
| Toner 1 | 115–230 | 115–230 | 115–230 | 115–230 | 140–180 | 130–190 |
| Toner 2 | 115–230 | 115–230 | 115–230 | 115–230 | 140–180 | 135–190 |
| Toner 3 | 115–230 | 115–230 | 115–230 | 115–230 | 140–180 | 135–190 |
| Toner 4 | 120–230 | 120–230 | 110–230 | 120–230 | 145–185 | 140–190 |
| Toner 5 | 120–230 | 120–230 | 120–230 | 120–230 | 145–175 | 140–175 |
| Toner 6 | 115–210 | 115–210 | 115–210 | 115–210 | 150–170 | 145–170 |
| Comparative Toner 1 | 150–180 | 150–180 | 150–185 | 150–185 | 150–170 | 145–175 |
| Comparative Toner 2 | 150–195 | 150–195 | 150–195 | 150–195 | 150–185 | 145–180 |

As is apparent from the above Tables 4 and 5, the heat fixing method of the invention exhibits a wider range of the temperature at which no offset occurs.

Evaluation of Stains of Pad Roller 8

Two hundred thousand sheets of paper were copied using the above developer from an original having a 5% line image density at 10° C. and 10% RH (relative humidity), and the pad roller 8 was observed for staining. Herein, the fixing temperature was 180° C. The copying of two hundred thousand sheets of paper was further continued, but was suspended for 10 hours every twenty thousand copying. The image copied immediately after the suspension was evaluated, and the number of the copies, in which stains occurred due to transfer of stains from the pad, was measured. The results are shown in Tables 6, 7, 8 and 9.

TABLE 6

| Toner | Heat Roller Fixing device (Staining of Pad) | | | | | |
|---|---|---|---|---|---|---|
| | R-1 | R-2 | R-3 | R-4 | R-C1 | R-C2 |
| Toner 1 | Slightly | Slightly | Slightly | Slightly | Considerably | Markedly |
| Toner 2 | Slightly | Slightly | Slightly | Slightly | Considerably | Markedly |
| Toner 3 | Slightly | Slightly | Slightly | Slightly | Considerably | Markedly |
| Toner 4 | Slightly | Slightly | Slightly | Slightly | Considerably | Markedly |
| Toner 5 | Slightly | Slightly | Slightly | Slightly | Considerably | Markedly |
| Toner 6 | Slightly | Slightly | Slightly | Slightly | Considerably | Markedly |
| Comparative Toner 1 | Considerably | Considerably | Considerably | Considerably | Considerably | Considerably |
| Comparative Toner 2 | Markedly | Markedly | Markedly | Markedly | Considerably | Considerably |

TABLE 7

| Toner | Film Material Fixing device (Staining of Pad) | | | | | |
|---|---|---|---|---|---|---|
| | F-1 | F-2 | F-3 | F-4 | F-C1 | F-C2 |
| Toner 1 | Slightly | Slightly | Slightly | Slightly | Considerably | Markedly |
| Toner 2 | Slightly | Slightly | Slightly | Slightly | Considerably | Markedly |
| Toner 3 | Slightly | Slightly | Slightly | Slightly | Considerably | Markedly |
| Toner 4 | Slightly | Slightly | Slightly | Slightly | Considerably | Markedly |
| Toner 5 | Slightly | Slightly | Slightly | Slightly | Considerably | Markedly |
| Toner 6 | Slightly | Slightly | Slightly | Slightly | Considerably | Markedly |
| Comparative Toner 1 | Considerably | Considerably | Considerably | Considerably | Considerably | Considerably |
| Comparative Toner 2 | Considerably | Considerably | Considerably | Considerably | Considerably | Considerably |

As is apparent from the above Tables 6 and 7, the heat fixing method of the invention exhibits fewer stains on the pad roller 8.

TABLE 8

| Toner | Heat Roller Fixing device (Numbers in which Stains Occurred) | | | | | |
|---|---|---|---|---|---|---|
| | R-1 | R-2 | R-3 | R-4 | R-C1 | R-C2 |
| Toner 1 | None | None | None | None | 120,000 | 140,000 |
| Toner 2 | None | None | None | None | 120,000 | 140,000 |
| Toner 3 | None | None | None | None | 100,000 | 120,000 |
| Toner 4 | None | None | None | None | 120,000 | 160,000 |
| Toner 5 | None | None | None | None | 100,000 | 120,000 |
| Toner 6 | 180,000 | 180,000 | 180,000 | 180,000 | 80,000 | 120,000 |
| Comparative Toner 1 | 40,000 | 40,000 | 40,000 | 40,000 | 20,000 | 20,000 |
| Comparative Toner 2 | 80,000 | 80,000 | 80,000 | 80,000 | 40,000 | 60,000 |

TABLE 9

| Toner | Film Material Fixing device (Numbers in which Stains Occurred) | | | | | |
|---|---|---|---|---|---|---|
| | F-1 | F-2 | F-3 | F-4 | F-C1 | F-C2 |
| Toner 1 | None | None | None | None | 120,000 | 160,000 |
| Toner 2 | None | None | None | None | 120,000 | 140,000 |
| Toner 3 | None | None | None | None | 140,000 | 160,000 |
| Toner 4 | None | None | None | None | 120,000 | 140,000 |
| Toner 5 | None | None | None | None | 120,000 | 140,000 |
| Toner 6 | None | None | None | None | 100,000 | 120,000 |
| Comparative Toner 1 | 40,000 | 60,000 | 60,000 | 60,000 | 80,000 | 100,000 |
| Comparative Toner 2 | 40,000 | 60,000 | 60,000 | 60,000 | 80,000 | 100,000 |

As is apparent from the above Tables 8 and 9, in the heat fixing method of the invention there are no stains in the further twenty thousand copies which occurred due to stain transfer from the pad roller 8.

What is claimed is:

1. A method of fixing a toner image onto a recording material comprising passing a recording material carrying said toner image between a heat member and a pressure applying member, thereby bringing said image into contact with said heat member, a silicone oil being on the surface of said heat member, when said image contacts said heat member, said toner including a polyester obtained from an aromatic polycarboxylic acid or an anhydride thereof and an aromatic polyhydric alcohol, said silicone oil containing a structured unit of the Formula I

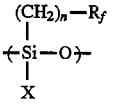

wherein X is a saturated hydrocarbon having 1 to 4 carbon atoms or an aryl group, $R_f$ is $-(CF_2)_mZ$ wherein Z is hydrogen or fluorine and m is an integer 2 to 10, and n is an integer 1 to 4.

2. The method of claim 1, wherein said silicone oil has the structure unit of Formula (I) in an amount of 20 mol % or more.

3. The method of claim 1, wherein said silicone oil has a viscosity of 20 to 1000 CS at 25° C.

4. The method of claim 3 wherein said silicone oil has a viscosity of 100 to 500 CS.

5. The method of claim 1, wherein said X represents methyl, ethyl, propyl, butyl, phenyl or naphthyl; and said $R_f$ represents $Z—(CF_2)_m—$ in which Z represents a hydrogen atom or a fluorine atom and m represents an integer of 2 to 10.

6. The method of claim 1, wherein said polyester comprises, in an amount of not more than 15 mol %, a unit from a tri or higher polyhydric alcohol or a unit from a tri or higher polycarboxylic acid.

7. The method of claim 1, wherein said polyester is cross-linked.

8. The method of claim 7, wherein said cross-linked polyester has a content of 5% by weight or more of chloroform insoluble components.

9. The method of claim 1, wherein the thickness of the silicone oil coated on the surface of the heat member is from a mono-molecular layered thickness to not more than $1.4\times10^{-6}$ cc/cm$^2$.

10. The method of claim 1, wherein the heat member is a heat roller.

11. The method of claim 1 wherein said aromatic polycarboxylic acid or anhydride is selected from the group consisting of phthalic acid, terephthalic acid, 1,2,4-benzenetricarboxylic acid, 2,5,7-naphthalenetricarboxylic acid, 1,2,4-naphthalenetricarboxylic acid, pyromellitic acid, and anhydrides thereof.

12. The method of claim 1 wherein the aromatic polyhydric alcohol is selected from the group consisting of polyoxypropylene (2. 2)-2,2-bis(4-hydroxyphenyl)propane, polyoxypropylene (3.3)-2,2-bis(4-hydroxyphenyl)propane, polyoxyethylene (2. 0)-2,2-bis(4-hydroxyphenyl)propane, polyoxypropylene (2. 0)-polyoxyethylene (2. 0)-2,2-bis(4-hydroxyphenyl) propane, polyoxypropylene (6)-2,2-bis(4-hydroxyphenyl)propane, bisphenol A, bisphenol Z, and 1,3,5-trihydroxymethylbenzene.

13. The method of claim 1 wherein the mole ratio of the polycarboxylic acid or anhydride to the alcohol is 1:0.95 to 1:0.5.

14. The method of claim 1 wherein the polyester has a weight average molecular weight (Mw) of $1\times10^4$ to $1\times10^6$ and a number average molecular weight (Mn) of $1\times10^3$ to $1\times10^5$.

15. The method of claim 14 wherein Mw is $2\times10^4$ to $5\times10^5$ and Mn is $2\times10^3$ to $3\times10^4$.

16. The method of claim 1 wherein the polyester has a ratio of weight average molecular weight (Mw) to number average molecular weight (Mn) of 4 to 50.

17. The method of claim 16 wherein said ratio of Mw to Mn is 5 to 30.

* * * * *